US007618053B2

(12) United States Patent
Marega et al.

(10) Patent No.: US 7,618,053 B2
(45) Date of Patent: Nov. 17, 2009

(54) SKI BOOT SOLE, DISENGAGEABLE SKI BINDING AND SKI BOOT BASE, AND COMBINATION THEREOF

(75) Inventors: Antonello Marega, Treviso (IT); Andrea Gabrielli, Predazzo (IT)

(73) Assignees: Marker Deutschland GmbH, Penzberg (DE); Tecnica S.p.A., Giavera Del Montello (TV) (IT); Völkl Sports GmbH & Co., KG, Straubing (DE)

( * ) Notice: Subject to any disclaimer, the term of this patent is extended or adjusted under 35 U.S.C. 154(b) by 462 days.

(21) Appl. No.: 11/515,999

(22) Filed: Sep. 5, 2006

(65) Prior Publication Data

US 2007/0063485 A1 Mar. 22, 2007

Related U.S. Application Data

(63) Continuation-in-part of application No. 10/723,336, filed on Nov. 26, 2003, now Pat. No. 7,100,938.

(30) Foreign Application Priority Data

Nov. 27, 2002 (DE) ..... 102 55 499

(51) Int. Cl.
*A63C 9/00* (2006.01)

(52) U.S. Cl. ..... 280/611; 280/613; 280/617

(58) Field of Classification Search ..... 280/11.3, 280/11.31, 11.33, 611, 613, 617, 618, 626, 280/629, 623, 631, 632
See application file for complete search history.

(56) References Cited

U.S. PATENT DOCUMENTS 3,918,732 A 11/1975 Wulf ..... 280/618
4,026,576 A 5/1977 Frechin ..... 280/613
4,182,524 A 1/1980 Beyl
4,191,395 A 3/1980 Salomon ..... 280/613
4,499,674 A * 2/1985 Olivieri ..... 36/117.3
4,893,831 A 1/1990 Pascal et al. ..... 280/618

(Continued)

*Primary Examiner*—Christopher P Ellis
*Assistant Examiner*—Brian Swenson
(74) *Attorney, Agent, or Firm*—D. Peter Hochberg; Sean F. Mellino; Daniel J. Smola

(57) ABSTRACT

A ski boot sole for cooperating with a ski binding to releasably hold the sole in the binding, the sole having a forward toe sole extending rearwardly from the front of the sole to a forward gap, a toe exterior insert in the forward gap which is located over a forward depression in the base of the ski boot, a central sole extending rearwardly from the front gap, a heel exterior insert located in a rearward gap over a rearward depression in the boot base and a heel sole extending from the rearward end of the rearward gap at least to the end of the boot. The foregoing boot sole is in combination with the base of the boot, and the base has forward and rearward recesses for receiving toe holders rotating about longitudinally extending axes and heel holders rotating about a transverse axis for releasably locking the respective toe exterior insert and heel exterior insert to the binding. The foregoing ski boot sole and ski boot base are in combination with a ski boot binding having portions rotating in the forward and rearward recesses for releasably engagement with the toe exterior insert and the heel exterior insert. A toe interior insert and a heel interior insert can be attached to the respective exterior inserts for respective attaching devices.

29 Claims, 11 Drawing Sheets

U.S. PATENT DOCUMENTS 5,086,575 A * 2/1992 Bonaventure ..... 36/117.3
5,762,357 A 6/1998 Ratzek et al. ..... 280/607
6,062,586 A * 5/2000 Korman ..... 280/613
6,120,038 A * 9/2000 Dong et al. ..... 280/7.13
6,338,497 B1 1/2002 Chevalier et al. ..... 280/612
6,428,032 B1 8/2002 Humbel ..... 280/613
6,467,795 B1 * 10/2002 Hirayama et al. ..... 280/613
6,736,411 B2 * 5/2004 Wang et al. ..... 280/7.13
6,773,024 B2 8/2004 Walkhoff ..... 280/613
7,073,813 B2 * 7/2006 Martin et al. ..... 280/613
7,073,814 B2 * 7/2006 Okajima et al. ..... 280/627

* cited by examiner

SKI BOOT SOLE, DISENGAGEABLE SKI BINDING AND SKI BOOT BASE, AND COMBINATION THEREOF

CROSS REFERENCE TO RELATED APPLICATION

This application is a continuation-in-part of U.S. patent application Ser. No. 10/723,336 filed Nov. 26, 2003, which claims priority from German patent application Serial No. 102 55 499.4 filed Nov. 27, 2002.

BACKGROUND OF THE INVENTION

1. Field of the Invention

The invention relates to a ski boot soles and to the combination of ski boot soles and ski boot bindings.

2. Description of the Prior Art

In the case of virtually all ski bindings which are currently available on the market, a front boot-retaining unit and a rear boot-retaining unit are arranged on the ski, the front boot-retaining unit interacting in a formfitting manner with the toe end, and the rear boot-retaining unit interacting in a formfitting manner with the heel end, of the "standard" sole of a ski boot. To be precise, the front boot-retaining unit prevents the toe end of the sole from moving forward in the longitudinal direction of the ski and from moving in the direction of the vertical and transverse axes of the ski, while the rear boot-retaining unit secures the heel end of the sole against moving rearward in the longitudinal direction of the ski and against moving in the direction of the vertical and transverse axes of the ski.

Such bindings have reached a high standard of development and a high level of reliability. In principle, however, they have the disadvantage that any dirt which accumulates between the soles and boot-retaining units may influence the disengaging behavior.

Consequently, U.S. Pat. No. 4,182,524 has already developed ski bindings in the case of which the ski boot stands on a standing and/or carrying plate of the binding, it being possible for this plate to be rotated about a vertical ski axis counter to an adjustable resistance. With the boot inserted into the binding, the boot sole is fixed on the carrying plate by means of boot-retaining elements on the plate, which interact with mating elements on the sole.

If the skier's boot or foot tries to execute a rotary movement with respect to the vertical axis of the ski when the skier falls, the resistance to rotation which is to be overcome during this rotary movement is determined, in the case of a binding according to U.S. Pat. No. 4,182,524, exclusively by elements of the binding which can be arranged, in principle, such that they are protected against dirt, for example, according to U.S. Pat. No. 4,182,524, within the standing and/or carrying plate.

Nevertheless, the binding according to U.S. Pat. No. 4,182,524 still does not have a satisfactorily reproducible behavior. The resistance to rotation which counteracts rotation of the standing and/or carrying plate about the vertical axis is determined by a spring arrangement which also gives rise to the disengaging resistance of the boot-retaining elements on the plate. The arrangement here is such that, during rotation of the standing and/or carrying plate about the vertical axis, the boot-retaining elements attain an increasing clearance for movement in the direction of their boot-releasing position. Conversely, the standing and/or carrying plate attains a clearance for rotation as soon as the boot-retaining elements are adjusted in the direction of their boot-releasing position by relative movements between the standing and/or carrying plate and boot sole. It is thus possible for dirt which is found between the standing and/or carrying plate and boot sole to influence, on the one hand, the disengaging behavior of the binding and, on the other hand, the restoring behavior of the binding within its so-called region of elasticity, within which disruptive forces acting on the binding result in movements of the binding elements or parts, but not in the binding being disengaged, with the result that, as the disruptive force dissipates again, the binding can be restored into the normal state, in which the boot is fixed in a predetermined desired position.

SUMMARY OF THE INVENTION

It is an object of the invention, then, in the case of a ski binding, to ensure disengaging and elasticity behavior which can be reproduced to particularly good effect.

This object is achieved according to the invention by a disengageable ski binding having a standing and/or carrying plate which is provided as a standing surface for a ski boot and is arranged on a base or bearing part, which is mounted on the ski and/or can be fitted firmly on the ski, such that it can be rotated about a vertical axis of the base part counter to an adjustable resistance of a first latching device, and having disengageable front and rear boot or sole holders which are arranged on the standing and/or carrying plate and which, in a use position, interact in a formfitting manner with mating surfaces or elements on the boot or boot sole and fix these essentially firmly on the standing and/or carrying plate, it being the case that the rear sole holders, in the case of disruptive forces which raise up the boot vertically from the standing and/or carrying plate, can be adjusted into a release position counter to an adjustable resistance of a second latching arrangement, which is separate from the first latching device, and/or the front boot or sole holders are locked within a predeterminable angle-of-rotation region of the standing and/or carrying plate in respect of the vertical axis, at least essentially without affecting the resistance of the first latching device, and are unlocked outside the region of rotation.

The invention is based on the general idea of ruling out any critical relative movement between the boot sole and standing and/or carrying plate within the region of elasticity of the binding. This is achieved, in the first instance, in that rotary movements of the standing and/or carrying plate about the vertical axis which are caused by disruptive forces, on account of the first and second latching devices being separate from one another and of the initially maintained locking of the front boot and/or sole holders, cannot result in any play, in particular clearance for rotation, of the boot sole relative to the standing and/or carrying plate. Within the region of elasticity, the rotary movement of the carrying and/or standing plate does not have any effect on the position of the boot and/or sole holders relative to the standing and/or carrying plate.

It should be emphasized here that the rear sole holders, according to a preferred embodiment of the invention, can be disengaged only in the vertical direction, i.e. by forces which try to raise up the heel region of the boot vertically from the standing and/or carrying plate. Accordingly, there is no possibility of any displacements between the sole and standing and/or carrying plate in the heel region if disruptive forces give rise to a torque between the boot and ski in respect of the vertical axis.

If any disruptive forces try to raise up the boot vertically from the standing and/or carrying plate, with adjustment of the rear boot holder in the direction of the disengagement state, it is not possible for any dirt between the standing and/or carrying plate and boot sole to have a disruptive influence.

According to a quite particularly preferred embodiment of the invention, the standing and/or carrying plate is assigned a torque support by means of which torques which act on the standing and/or carrying plate in respect of a transverse plate axis are converted into torques in respect of the vertical axis, and a moment which assists further rotation of the standing and/or carrying plate about the vertical axis is produced as soon as the standing and/or carrying plate has left a central position or a central position region. This makes it possible to allow for the fact that torsional loading of the shin and of the ankles and knee joints are to be reduced when the leg is subjected to additional stressing by further forces such as those which typically arise when the skier falls in the forward or rearward direction. Because of the abovementioned torque support, the disruptive forces which are responsible for further stressing are thus used in order to reduce the resistance to rotation which counteracts rotation of the standing and/or carrying plate about the vertical axis, with the result that a rotary displacement of the standing and/or carrying plate which unlocks the front boot or sole holders, and thus release of the boot, are achieved relatively easily.

In addition, as far as preferred features of the invention are concerned, the claims and the following explanation of the drawing illustrate these, with reference to which a particularly preferred embodiment and a number of possible modifications are described in more detail. Protection is claimed here not just for combinations of features which are expressly given in the claims or the description, but also for basically any desired sub-combinations of the features illustrated.

Another feature of the present invention is to provide a ski boot sole having spaced structure for cooperating with ski bindings, where the spacing is constant regardless of changes in sizes of the ski boot sole. The portion can also cooperate or interact with similarly fixed ski binding structure with a play-free form fit. The ends of the ski boot sole can have different shapes since they do not interact with the ski binding.

DESCRIPTION OF THE DRAWINGS

A preferred embodiment of the ski boot sole according to the invention comprises a toe insert disposed on the bottom of the base of a boot which cooperates with a threaded toe insert on top of the base of the boot in alignment with the toe insert which cooperate with a fastener to attach the toe insert and toe threaded insert to the sole, and a heel insert disposed on the bottom of the boot which cooperates with a threaded heel insert on top of the base of the boot in alignment with the heel insert to cooperate with a fastener to attach the rear insert and rear threaded insert to the base. The toe insert and the heel insert are separated by a fixed distance regardless of the size of the boot sole. The toe insert and the heel insert cooperate with a ski binding to releasably latch the ski boot sole to the ski on which the ski binding is attached.

The invention may take physical form in certain parts and arrangement of parts, a preferred embodiment of which will be described in detail in the specification and illustrated in the accompanying drawings which forms a part hereof, and are not meant to limit same, and wherein.

DESCRIPTION OF THE PREFERRED EMBODIMENTS

Figure 2:
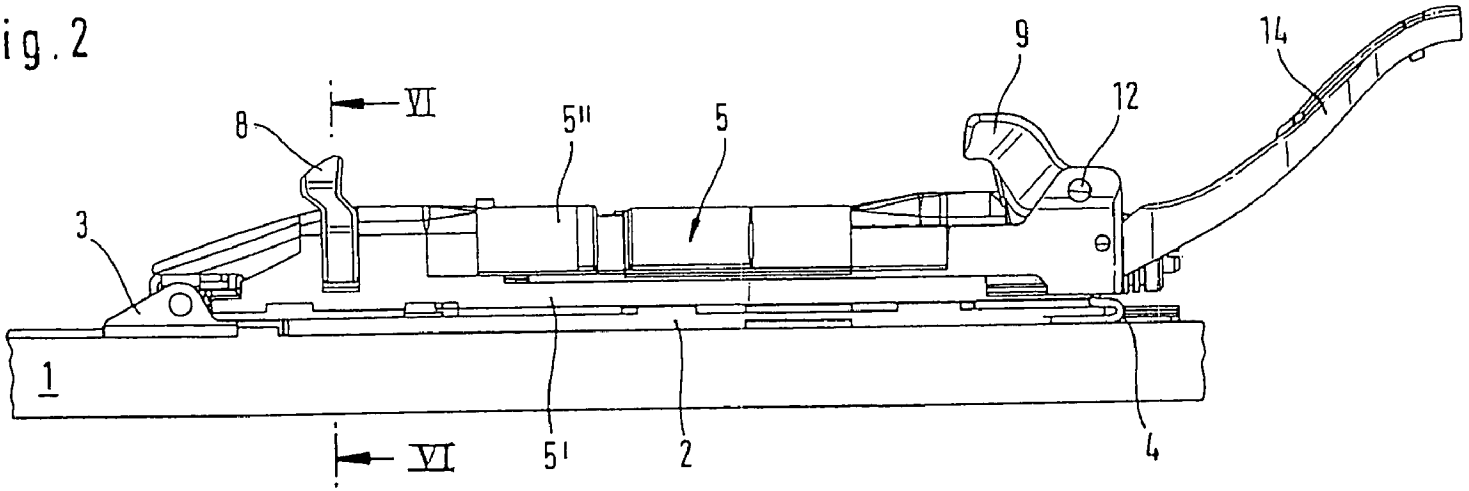
FIG. 2 shows an associated side view.

The binding according to the invention has a base plate 2 which is arranged on a ski 1, indicated partly in FIG. 2, which is connected at its front end, as seen in the longitudinal direction of the ski, in a hinge-like manner to a bearing part 3, arranged firmly on the ski, such that it can be pivoted about a transverse ski axis, and which is secured vertically, with displaceability in the longitudinal direction of the ski, at its rear end, as seen in the longitudinal direction of the ski, in a further ski-mounted bearing part 4.

Arranged on the base plate 2 is a standing and/or carrying plate 5, which can be rotated about a vertical axis of the base plate 2 and of which the top side serves as a standing and/or supporting surface for the sole of a ski boot which is to be inserted into the ski binding. The standing and/or carrying plate 5 has a bottom plate part 5', designed as a frame and structural part, and a covering part 5" on the top side. The abovementioned connection between the base plate 2 and standing and/or carrying plate 5, it being possible for said connection to be pivoted about a vertical axis, is arranged between the base plate 2 and the bottom plate part 5', it being possible for the pivot bearing to be formed, for example, by an elevation in the form of a circular disk being integrally formed on the underside of the bottom plate part 5', said elevation engaging in a correspondingly circular recess in the base plate 2 and being connected firmly to a flange plate 6 (see FIG. 3) which is arranged on the underside of the base plate and overlaps the abovementioned circular recess of the base plate 2 in the radially outward direction.

Figure 1:
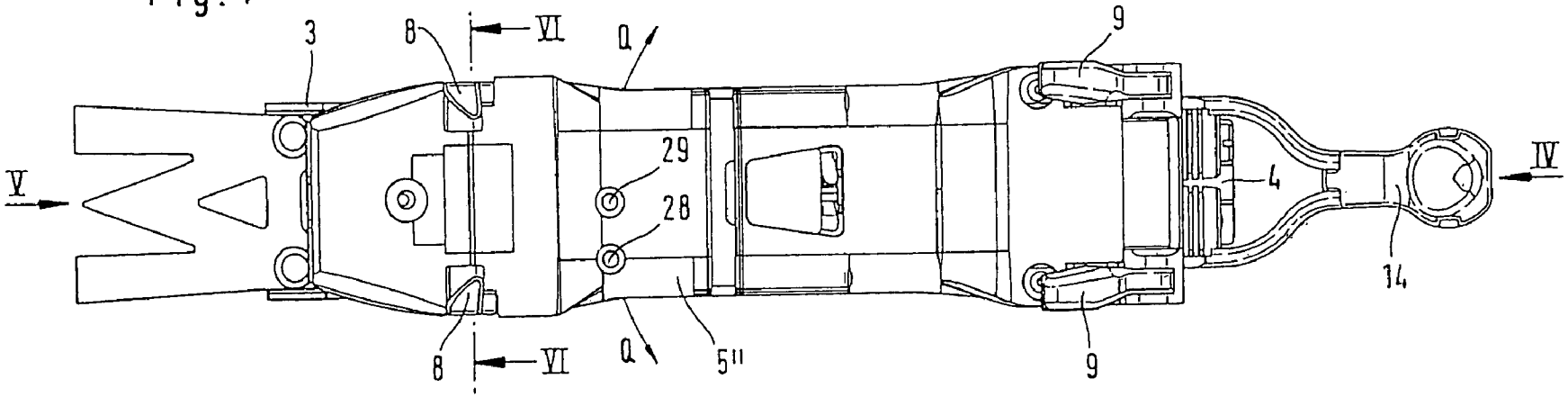
FIG. 1 shows a plan view of the top side of a binding according to the invention.
Figure 3:
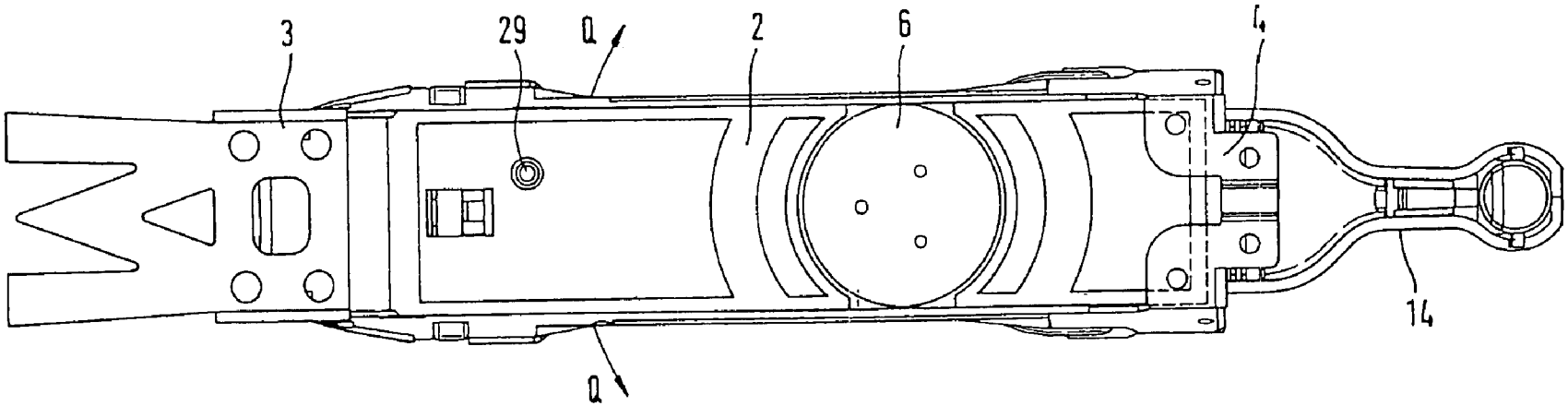
FIG. 3 shows an associated plan view of the underside of the binding.
Figure 5:
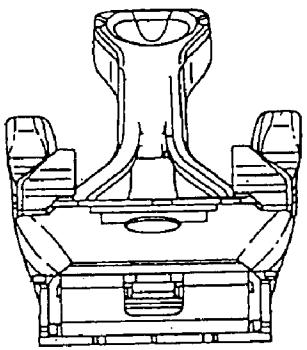
FIG. 5 shows a front view of the binding according to the arrow V in FIG. 1.
Figure 4:
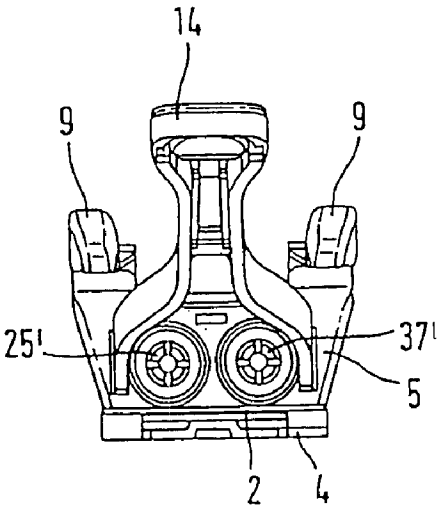
FIG. 4 shows a rear view of the binding according to the arrow IV in FIG. 1.

The standing and/or carrying plate 5 (see FIG. 2) is kept in the central position, which is illustrated in FIGS. 1 and 3, by a first latching device 7, which is explained in more detail below. The carrying plate 5 can be rotated relative to the longitudinal axis of the ski and/or of the base plate 2, counter to the resistance of the abovementioned latching device 7, corresponding to the arrows Q in FIGS. 1 and 3.

Figure 10:
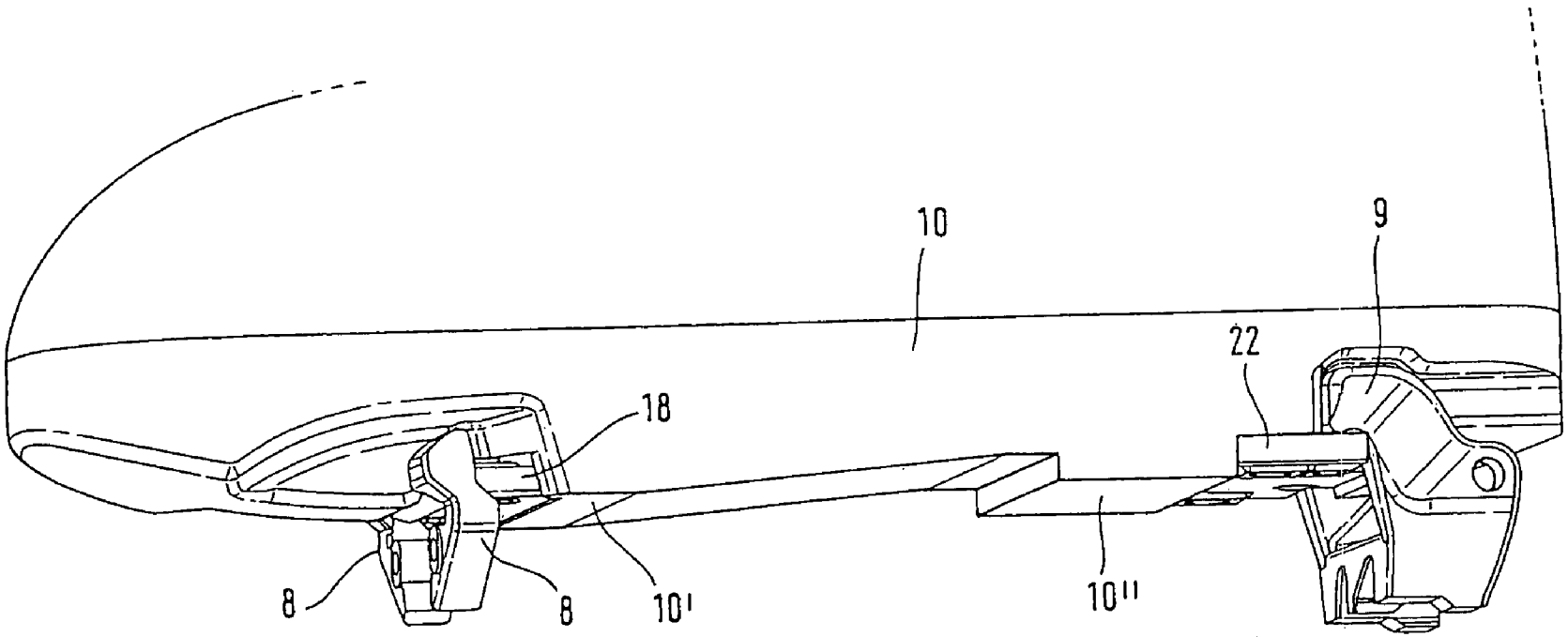
FIG. 10 shows a perspective illustration of the underside of the sole and of the front and rear sole holders interacting with fitting parts on the sole.

Front and rear sole holders 8 and 9 are arranged on the standing and/or carrying plate 5, and the sole 10 of a boot inserted into the binding is fixed in a virtually immovable manner on the standing and/or carrying plate 5 by means of said sole holders in their use position (see, for example, FIGS. 1, 2 and 10).

In the embodiment of FIGS. 1, 2 and 10, the front sole holders 8 can be pivoted into a release position, to the side of the standing and/or carrying plate 5, about axes 11 (see FIG. 6) extending in the longitudinal direction of the standing and/or carrying plate 5, while the rear sole holders 9 can be tilted into a release position about an axis 12 extending in the transverse plate direction.

As is described in more detail below with the explanation of the first latching device 7, the front sole holders 8 are locked in their use position when the standing and/or carrying plate 5 assumes its normal position according to FIGS. 1 and 3 or a position within a pivoting region which is provided for the region of elasticity of the binding and is located on both sides of the normal position. As soon as this pivoting region is exceeded to the right or left, the front sole holders 8 are unlocked, with the result that they can readily be swung or moved into their release position.

The rear sole holders 9 can interact with a second latching device 13, which is explained in more detail below, and with an actuating lever 14. In the case of corresponding disruptive forces or moments acting on the rear sole holders 9, the rear sole holders 9 are tilted, in the clockwise direction in FIG. 2, in a self-retaining release position. It is also possible for the rear sole holders 9 to be changed over between the use position and release position by the actuating lever 14, or for the rear sole holders to interact with the first latching device 7.

Figure 9:
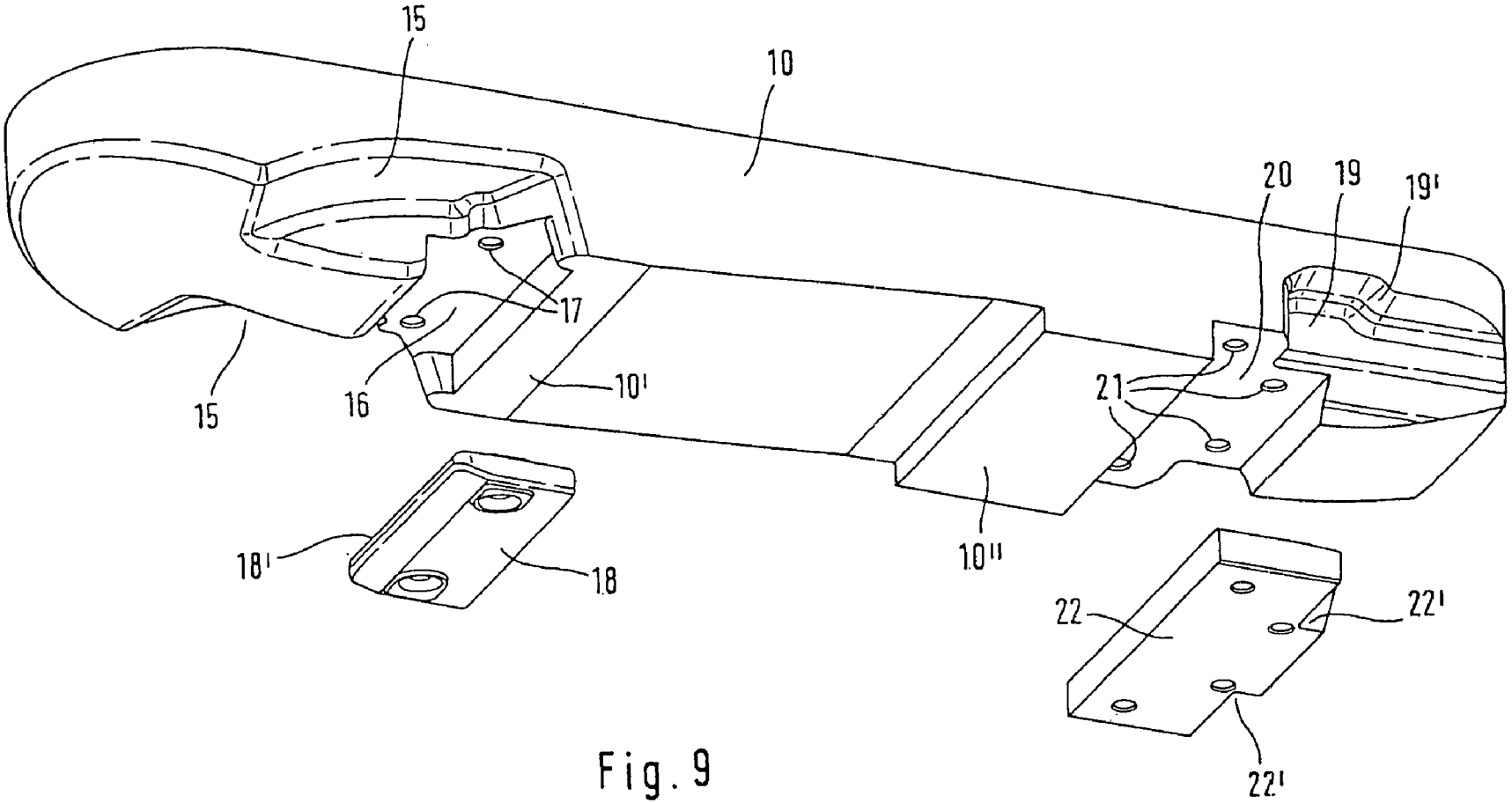
FIG. 9 shows a perspective exploded illustration of the underside of a ski-boot sole interacting with the binding according to the invention.

According to FIGS. 9 and 10, the sole 10 of the ski boot which is to be inserted into the binding has, approximately in the ball-of-the-foot region and/or at a relatively large distance from the toe end of the sole, recesses 15, which are open in relation to the underside of the sole and in relation to the longitudinal borders of the sole, and a depression 16, which is open in the downward direction and in relation to the abovementioned recesses 15 and has a planar base which is provided with accommodating bores 17 for screws or the like. A fitting plate 18 is arranged in the depression 16 and fastened by screws or the like (not illustrated), which are screwed into the accommodating bores 17. The fitting plate 18 has a slightly wedge-shaped front edge 18', of which the corner regions are accommodated in a formfitting manner by corresponding recesses of the front sole holders 8 when the front sole holders 8 assume their use position and the sole 10 is pushed, by way of the front edge 18' of the fitting plate 18, into the abovementioned recesses of the sole holders 8 in the longitudinal direction of the sole, the sole 10 being seated flatly, by way of an underside region 10' adjacent to the fitting plate 18, on the top side of the standing and/or carrying plate 5 in the vicinity of the front sole holders 8.

The abovementioned form fit between the corner regions of the front edge 18' of the fitting plate 18 and the recesses of the front sole holders 8 is designed such that the sole 10 is secured and/or arrested against displacement in the forward, sideways and vertical directions.

The rear region of the sole 10 contains recesses 19 which are open in the downward direction and in relation to the side borders of the sole 10 and merge into a depression 20 which is remote from the rear sole end, is open in the direction of the recesses and in the direction of the underside of the sole and has a planar base with accommodating bores 21 for screws or the like. A fitting plate 22 is arranged in this depression 20 and fixed by screws or the like (not illustrated), which are screwed into the abovementioned accommodating bores 21. The fitting plate 22 is T-shaped in plan view, such that angled indents 22' are formed in the fitting plate 22.

In their use position, the rear sole holders 9, with the boot inserted into the binding, engage over the upwardly-oriented side of the fitting plate 22 from above in the region of the indents 22', in which case those borders of the indents 22' which extend in the longitudinal direction of the sole butt against the mutually facing flanks of the rear sole holders 9 and those borders of the indent 22' which extend in the transverse direction of the sole butt against the front borders of the rear sole holders 9, these borders being essentially vertical in the use position, and an underside region 10" of the sole 10, which extends in front of the fitting plate 22, rests flatly on the top side of the standing and/or carrying plate 5 in the vicinity of the rear sole holders 9. Accordingly, by virtue of a form fit between the fitting plate 22 and the rear sole holders 9, the rear sole region is secured against movement in the rearward, sideways and vertical directions.

The sole 10 need be of rigid design essentially only between the fitting plates 18 and 22, such that the fitting plates 18 and 22 are always in a reproducible position in relation to the regions 10' and 10" on the underside of the sole 10 and, accordingly, can interact with the sole holders 8 and 9 with a play-free form fit. The sole regions in front of and behind the fitting plates 18 and 22 may be formed, for the most part, as desired. In particular, it is possible for the underside of the sole to be curved in these regions so as to facilitate a rolling movement of the foot during walking.

A preferred embodiment of the ski boot sole according to the invention is shown in FIGS. 11-23. FIGS. 11-18 show a ski boot sole 100 which is partially made from rubber and mounted to the bottom of a ski boot B. With particular reference to FIG. 13, the sole 100 comprises a toe rubber sole 102 which is secured to boot B from partway up the toe of boot B and extending rearwardly. A forward gap 103 in boot sole 100 is provided as discussed below, and a central rubber sole 104 extends from forward gap 103 rearwardly and terminates near the middle of boot sole 100. A heel rubber boot sole 106 is attached to a base 200 of boot B and extends rearwardly and upwardly to cover the rear lower upper part of boot B. Rubber boot soles 104 and 106 are threaded for walking when the skier is detached from the binding. A toe metal exterior insert 108, corresponding to front fitting plate 18, is provided in forward gap 103 between toe rubber sole 102 and central rubber sole 104. Toe metal exterior insert 108 is covered by a protective plastic coating 110. Toe metal exterior insert 108 is provided in a forward depression 202 in the bottom of base 200 of boot B which is configured to snugly receive toe metal exterior insert 108 with its plastic coating 110. Disposed rearwardly is a heel metal exterior insert 114 which has a plastic coating 116, and is located in a rearward depression 204 in base 200 of boot B which is also configured to snugly receive heel metal exterior insert 114 with the plastic coating 116.

Figure 11:
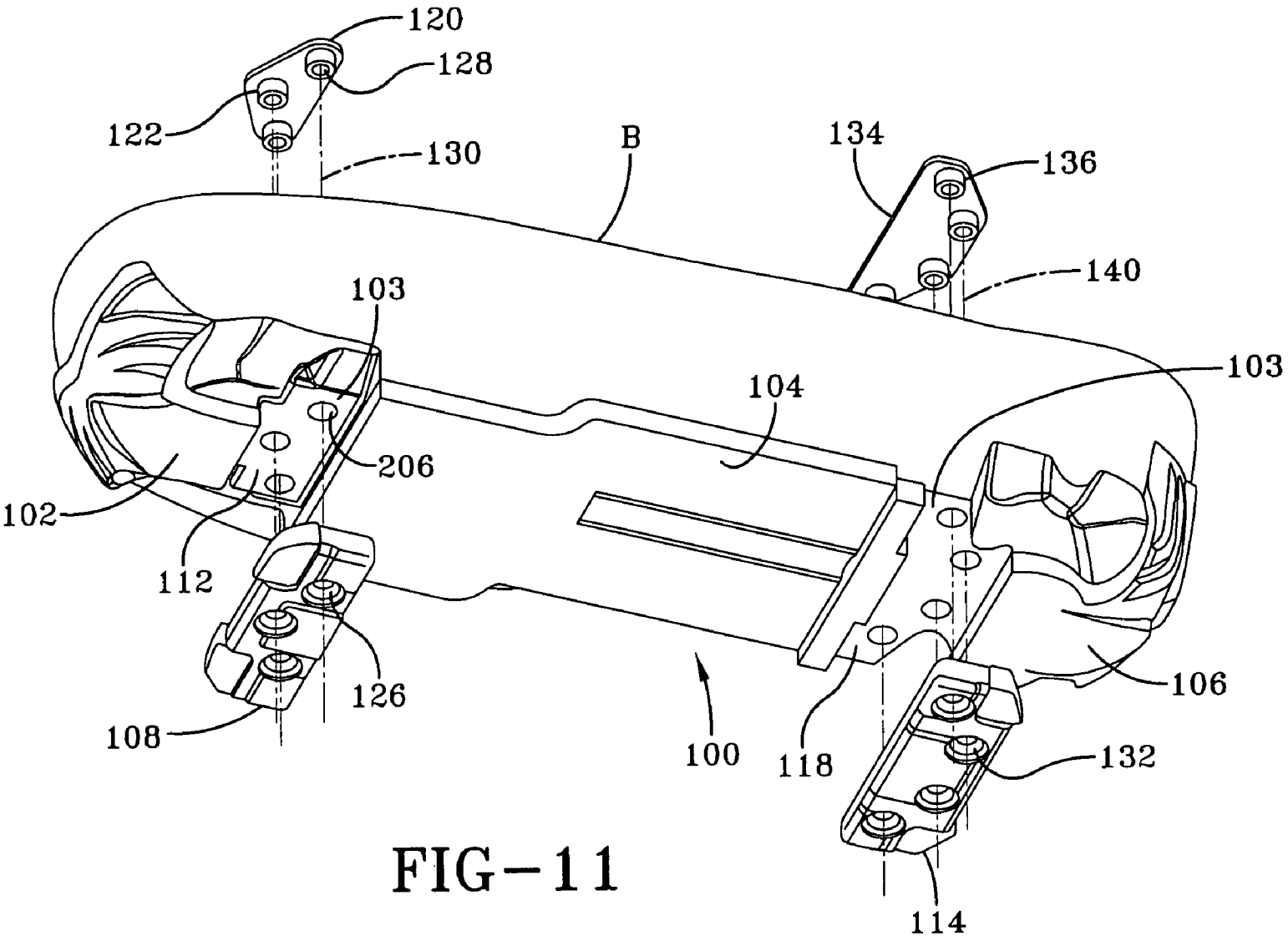
FIG. 11 is an exploded view of a second embodiment of the inventive ski boot sole.

Referring to FIGS. 11 and 13 in particular, a toe threaded interior insert 120 having three tubular extensions 122 with bores 128, and extensions 122 extend downwardly into three holes 206 extending through the top of base 200 of ski boot B.

Toe metal exterior insert 108 has three countersunk threaded bores 126. Toe metal exterior insert 108 and toe threaded internal insert 120 are mounted on boot B in depression 202 and recess 206, respectively, so that their longitudinal axes 130 are in alignment for receiving screws to attach inserts 108 and 120 together and mount toe metal exterior insert 108 in place.

Likewise, heel metal exterior insert 114 has four recessed threaded bores 132. A heel threaded interior insert 134 has four tubular extensions 136 which fit into recesses 208 in the upper part of the base of boot B. Heel metal exterior insert 114 and heel threaded interior insert 134 are mounted on the lower and upper part of the base of boot B so that their longitudinal axes 140 are in alignment, so that screws can be inserted into bores 132, through a corresponding set of holes, and into tubular extensions 136 to hold these parts in place.

Figure 20:
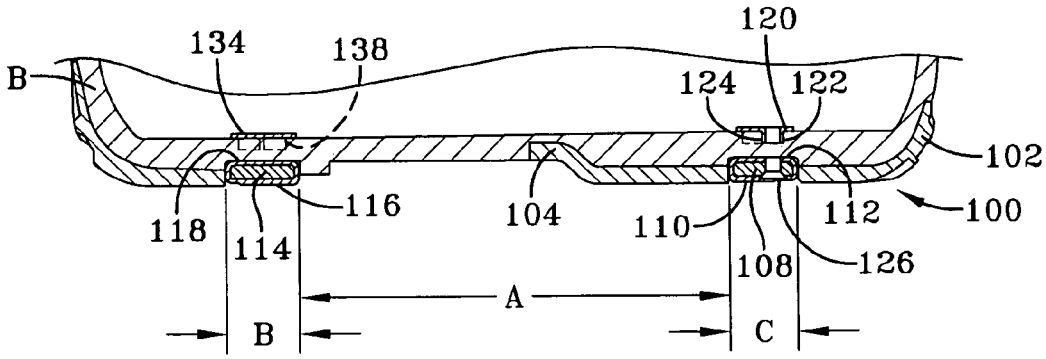
FIG. 20 is a view taken in the direction 20-20 in FIG. 19.
Figure 21:
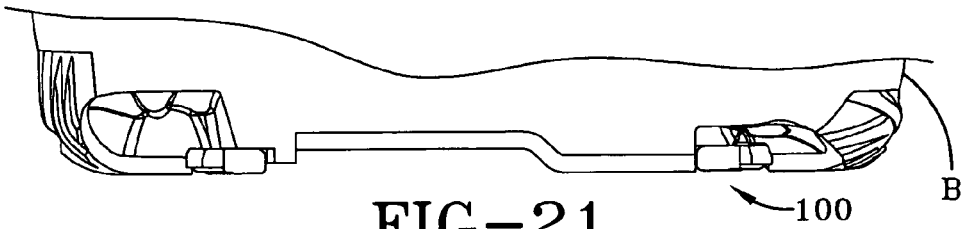
FIG. 21 is a side view of the sole and boot shown in FIG. 19.
Figure 22:
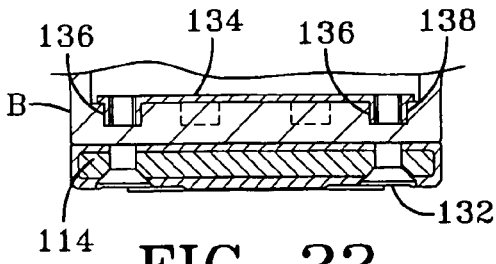
FIG. 22 is a view taken in the direction 22-22 in FIG. 19.
Figure 23:
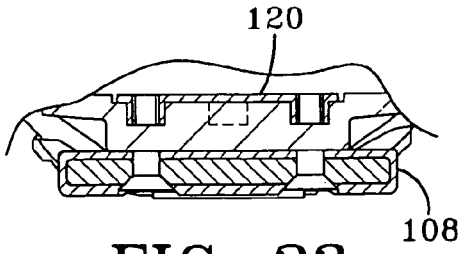
FIG. 23 is a view taken in the direction 23-23 in FIG. 19.
Figure 24:
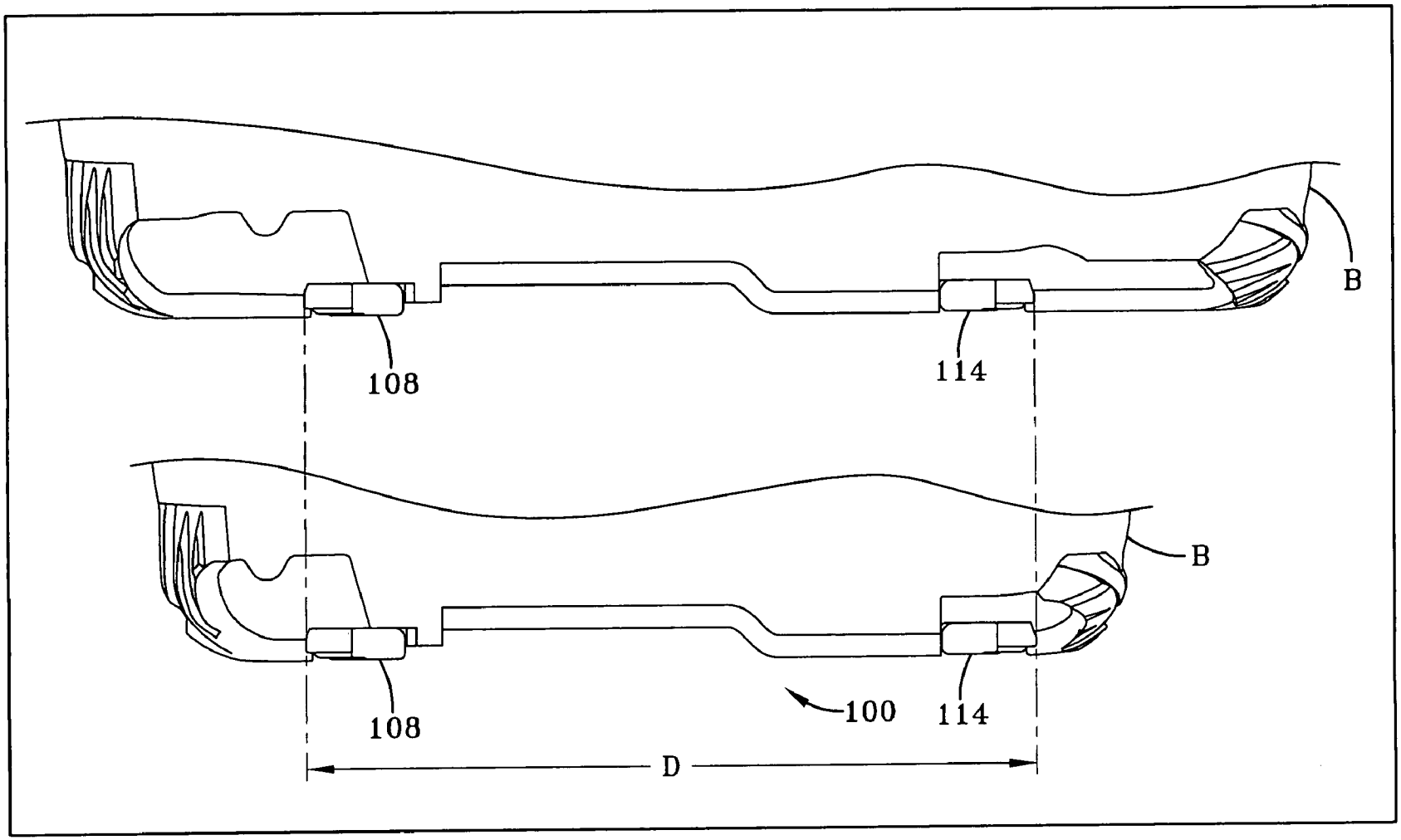
FIG. 24 is a side view of two ski boot soles according to the invention, the soles having different sizes.

Referring to FIGS. 13 and 20, the forward and rearward parts of toe metal exterior insert 108 and heel metal exterior insert 114 are spaced apart by a fixed dimension A. This dimension remains the same regardless of the size of the ski boot sole 100 upon which metal exterior inserts 108, 114 are attached. This avoids manufacturing problems since that portion of the ski boot sole 100 is always fixed, as are the cooperating parts of the ski binding. It has been found that a particularly advantageous length of dimension A is 148 mm, with a plus/minus tolerance of 10 mm. It is also useful that the toe exterior metal insert 108 should always have a fixed longitudinal dimension C regardless of the size of the boot sole 100, as heel metal exterior insert should have a fixed longitudinal dimension B regardless of the size of boot sole 100. It has been found to be of advantage where dimension A is 148 mm ±10 mm and for both dimension B and dimension C to be 25 mm, so that the total length of A+B+C is about 200 mm. The foregoing is shown in FIG. 24 where there is a fixed dimension D that is the sum of the distance between the rearward end of toe metal insert 108 and the forward end of heel threaded exterior insert 114, the longitudinal length of toe metal exterior insert 108, and the longitudinal length of heel metal exterior insert 114. In the preferred embodiment, D equals about 200 mm.

Figure 16:
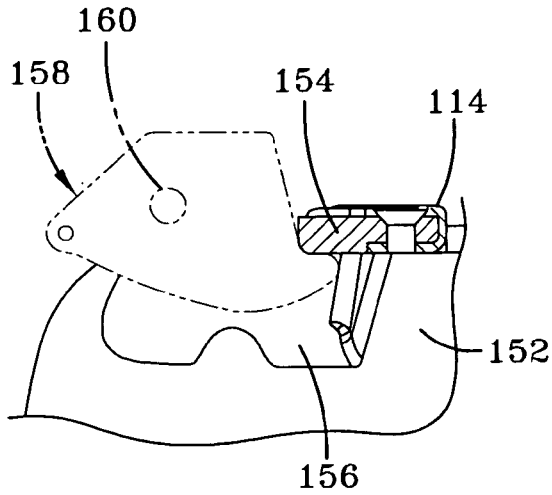
FIG. 16 is a view taken in the direction 16-16 in FIG. 12, shown on inverted position.

FIG. 16 shows that heel metal exterior insert 114 is mounted on a downwardly-extended ridge 152 of boot sole 100, and that heel metal exterior insert 114 has a rearwardly-extending rear portion 154 which is disposed under a rear recess 156. A heel clamp 158 pivotal about a transverse axis 160 releasably engages heel metal exterior insert 114 to releasably secure the heel inset to the binding and the ski.

Figure 12:
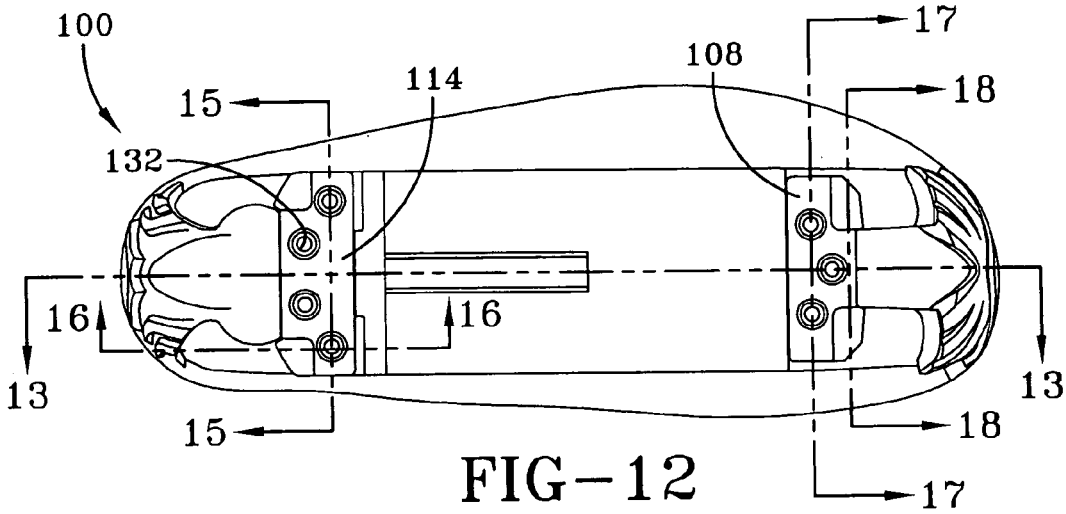
FIG. 12 is a bottom plan view of the second embodiment of the ski boot sole and part of a boot according to the invention.
Figure 13:
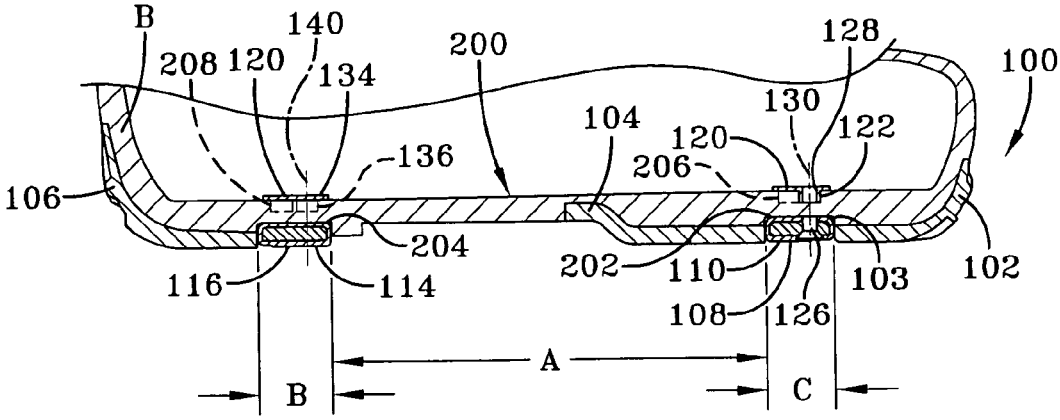
FIG. 13 is a view taken in the direction 13-13 in FIG. 12.
Figure 14:
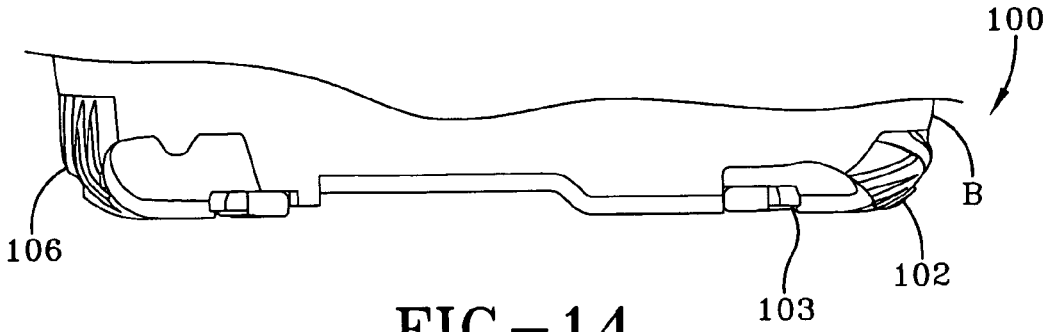
FIG. 14 is a side view of the boot sole and a portion of a boot shown in FIG. 12.
Figure 15:
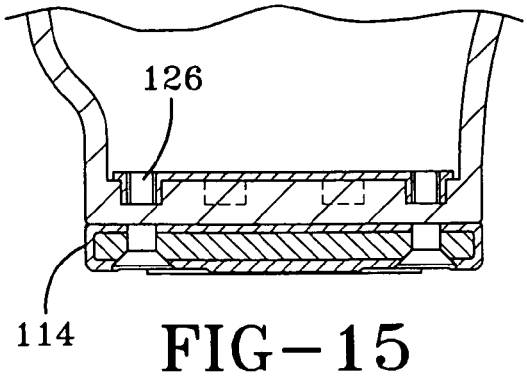
FIG. 15 is a view taken in the direction 15-15 in FIG. 12.
Figure 17:
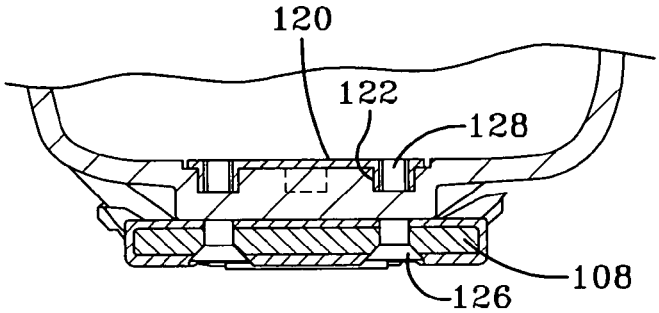
FIG. 17 is a view taken in the direction 17-17 in FIG. 12.

FIG. 17 is a cross-sectional view taken in the direction of the arrows in FIG. 12. Toe metal exterior insert 108 is shown in position for being mounted on the boot base, where bores 126 are aligned with bores 128 of tubular extensions 122 so that toe metal insert 108 can be connected to toe threaded interior insert 120.

Figure 18:
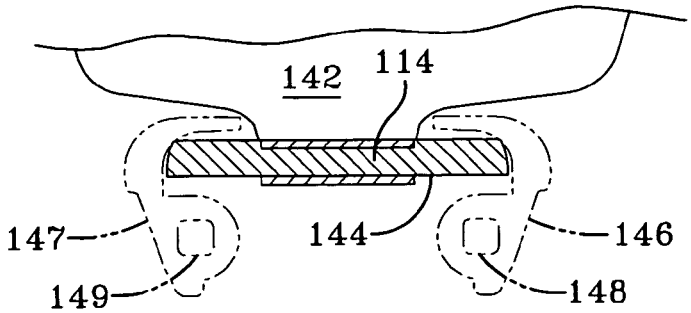
FIG. 18 is a view taken in the direction 18-18 in FIG. 12.
Figure 19:
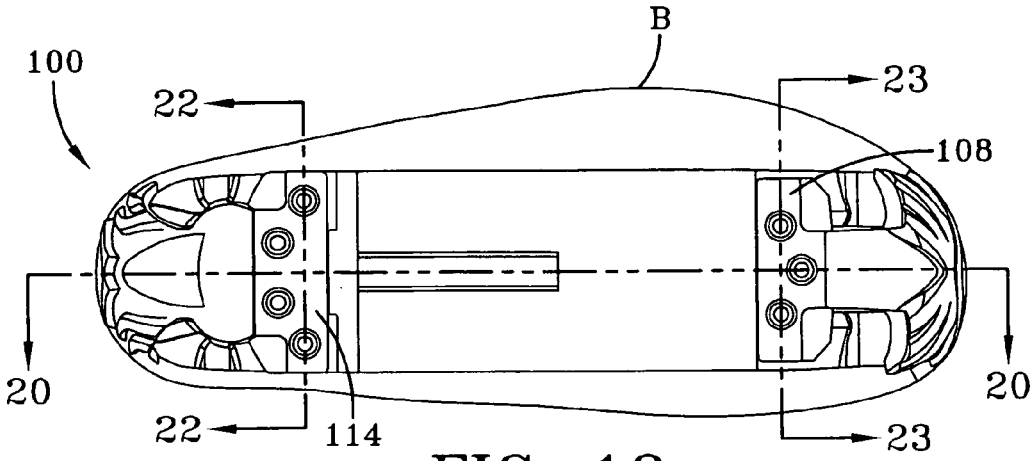
FIG. 19 is a bottom view of the inventive ski boot sole and part of a boot, according to a modification of the embodiment shown in FIGS. 11-18.

FIG. 18 shows that toe metal exterior insert 114 is mounted at its forward end on a downwardly-extending part 142 of boot sole 100, and has outwardly-extending side portions 144 which are releasably engaged by toe holders 146, 147 which rotate around longitudinal axes 148, 149 to releasably lock the heel of ski boot sole 100 to the binding.

Figure 6:
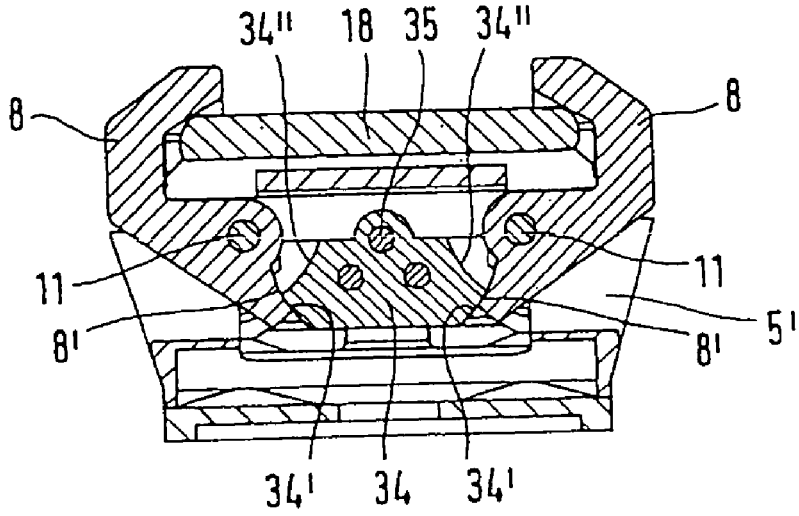
FIG. 6 shows a sectional view corresponding to section line VI-VI in FIGS. 1 and 2.
Figure 7:
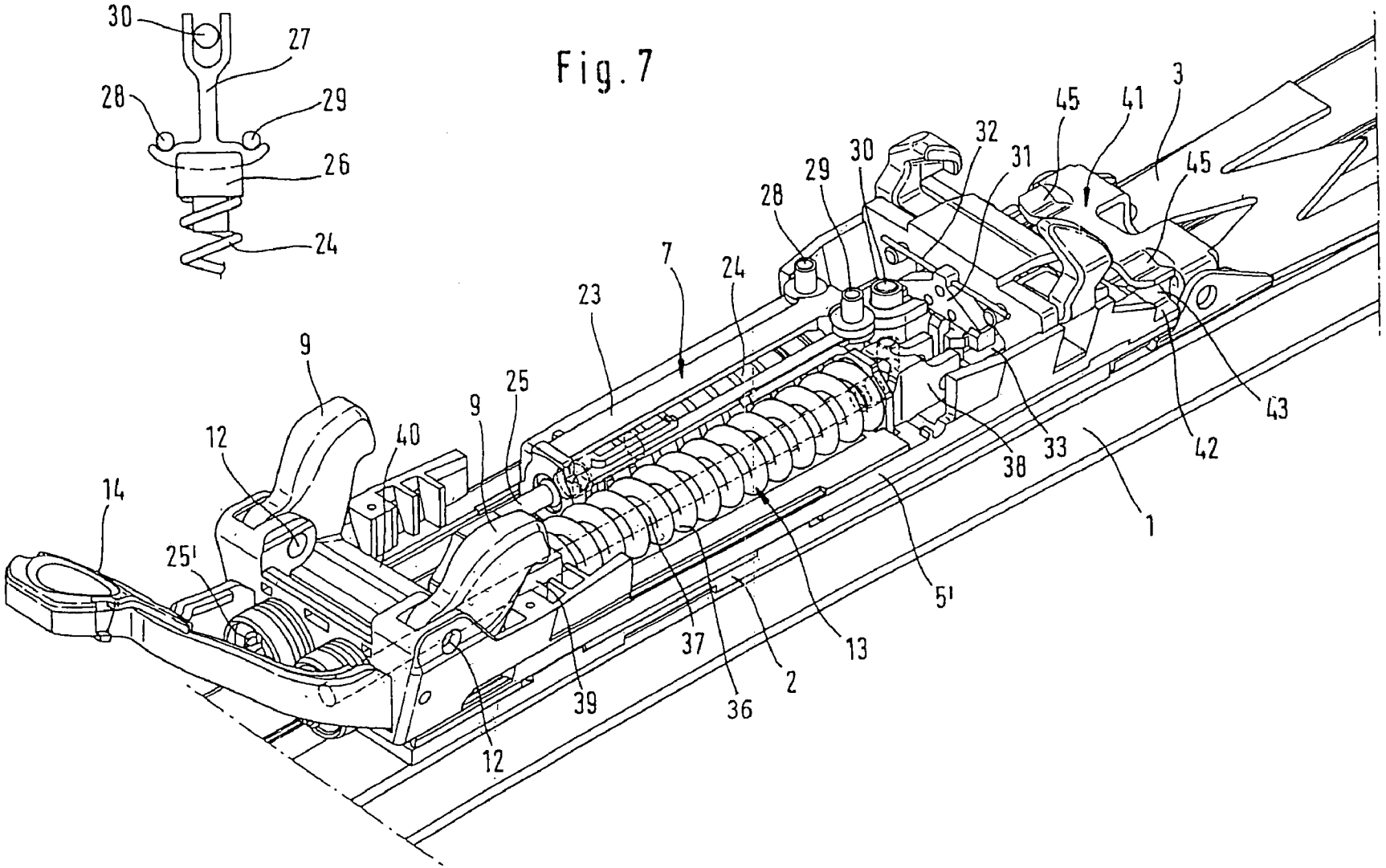
FIG. 7 shows a perspective plan view of the binding according to the invention with the standing and/or carrying plate open on the top side.

Returning to the binding discussed with respect to FIGS. 1-8, the first latching device 7, according to FIG. 7, has a spring housing 23, which is arranged firmly on the bottom plate part 5' of the standing and/or carrying plate 5 and accommodates a helical compression spring 24. One end of the helical compression spring 24 is supported on a spring abutment, which can be adjusted in the longitudinal direction of the spring housing 23 by means of an adjusting screw 25, with the result that it is possible to change the spring stressing by means of a screwing tool which can be attached to the head 25' of the adjusting screw 25, said head being accessible at the rear border of the standing and/or carrying plate 5. The other end of the helical compression spring 24, according to the separate detail form illustration in FIG. 7, is held under stressing against a piston 26, which can be displaced in the spring housing 23 and, for its part, is held under stressing, by the spring force, against a facing transverse member of a tilting lever 27, said transverse member of the tilting lever 27 engaging in a transverse slot on the facing side of the piston 26. The transverse member of the tilting lever 27 interacts with tilting pins 28 and 29, which are firmly arranged as parts of the spring housing 23 and around which the transverse member of the tilting lever 27, in the normal position thereof, engages by way of corresponding, approximately semicircular recesses. The helical compression spring 24 and the piston 26 on which the latter acts try to keep the transverse member of the tilting lever 27 in abutment against the two tilting pins 28 and 29. If the tilting lever 27 is pivoted about one of the tilting pins 28 or 29 by corresponding forces, the piston 26 is forced back counter to the force of the helical compression spring 24 as soon as the tilting lever 27 is subjected to a moment which overcomes the prestressing of the helical compression spring 24.

The tilting lever 27 engages, by way of a fork-like end, around a pin 30 which is firmly arranged on the base plate 2. Correspondingly, the tilting lever 27 has to be deflected out of its normal position, which is illustrated in FIG. 7, with pivoting about the tilting pin 28 or 29, when the standing and/or carrying plate 5 on the base plate 2 executes a rotary movement about the vertical axis passing centrally through the flange plate 6 (see FIG. 3).

As a result, it is thus only possible for the standing and/or carrying plate 5 to execute a rotation about the abovementioned vertical axis on the base plate 2 when the standing and/or carrying plate 5 is subjected to a sufficient torque, the magnitude of which is determined by the prestressing of the helical compression spring 24. As soon as this torque is exceeded, the standing and/or carrying plate 5 is pivoted to a more or less great extent.

On a part which is connected firmly to the bottom plate part 5' of the standing and/or carrying plate 5, a yoke 31 is arranged such that it can be pivoted about a longitudinal plate axis. A leg spring 32 forces the yoke 31 into the normal position, which is illustrated in FIG. 7. The ends of the yoke 31 interact, in the manner of cams, with a guide track or guide curve 33 firmly arranged on the base plate 2, such that the yoke 31 executes a pivoting movement in one direction or the other when the standing and/or carrying plate 5 is pivoted relative to the base plate 2 in one direction or the other.

The yoke 31 is coupled in a rotationally fixed manner to a control plate 34, which can be seen in FIG. 6 and has circle-arc-shaped border sections 34' located centrally in relation to the pivot pin 35, and adjoining border sections 34" which are located more or less radially in relation to the pivot pin 35.

In the normal position of the yoke 31 and of the control plate 34, the border sections 34' butt against associated borders 8' of the front sole holders 8, which are in the form of double levers according to FIG. 6, with the result that these are locked in their use position. When the standing and/or carrying plate 5 is pivoted sufficiently widely relative to the base plate, the control plate 34 executes a pivoting displacement of such a magnitude that one of the front sole holders 8 is freed from the associated border section 34' of the control plate 34 and, by way of its control-plate end, can slide onto the adjacent border section 34" and, accordingly, execute a pivoting movement into its release position. The kinematics between the yoke 31 and guide track or guide curve 33 here are such that, in the case of a corresponding pivoting displacement of the standing and/or carrying plate 5, that sole holder 8 which is arranged on that border side of the standing and/or carrying plate 5 which is oriented in the respective pivoting direction tilts, or can tilt, into its release position.

The second latching device 13, which controls the rear sole holders 9, has a helical compression spring 36, which is clamped in between an abutment 38, which can be displaced on the bottom part 5' of the standing and/or carrying plate 5 by means of an adjusting screw 37, and a piston 39, which can be displaced on the bottom plate part 5'. The threaded part of the adjusting screw 37 is connected in a non-rotatable and axially fixed manner to the abutment 38 and bears an adjusting nut 37' which is accessible from the outside and is mounted in an axially rotatable manner on the rear side of the standing and/or carrying plate 5, with the result that, by screwing adjustment of the adjusting nut 37' on the adjusting screw 37, it is possible to adjust the distance between the abutment 38 and the adjusting nut 37' and thus the prestressing of the helical compression spring 36.

On its end side which is directed toward the rear sole holders 9, the piston 39 has a track-like guide surface which interacts with a cam part, which cannot be seen in FIG. 7, and is arranged on a connecting component 40 which connects the rear sole holders 9 to one another in a rotationally fixed manner and may be integrally formed with the sole holders 9. The cam part and the curved surface here interact such that the piston 39, in the first instance, has to execute a comparatively large displacement counter to the compressive force of the helical spring 36 when the rear sole holders 9 are pivoted rearward by a comparatively small extent out of the use position, which is illustrated in FIG. 7. As the rear sole holders are pivoted further, they pass through a dead-center position between the cam part and track-like curved surface. Thereafter, the cam part of the rear sole holders 9 interacts with part of the curved surface such that the piston 39 is forced rearward by the helical compression spring 36 and the rear sole holders 9 are forced into their release position.

If required, it is also possible for the rear sole holders 9 to be disengaged manually or by means of a ski stick which, for this purpose, is positioned in a depression at the free end of the actuating lever 14 in order to press the lever 14 down toward the top side of the ski.

By virtue of the lever 14 being raised, it is possible for the rear sole holders 9 to be moved, if appropriate, manually into their use position.

It is also possible, when the boot is inserted, for the rear sole holders 9 to be adjusted from their release position into the use position by the boot. Stop steps 19' are formed on the rear recesses 19 of the boot sole 10 (as shown in FIG. 9) and interact with those borders of the rear sole holders 9 which are directed obliquely upward in FIG. 10, with the result that said sole holders are inevitably changed over into their use position when the boot is inserted, by way of the front fitting plate 18, into the front sole holders 8 and then is pushed down, by way of its heel region, against the top side of the standing and/or carrying plate 5. The binding according to the invention is thus designed as a so-called step-in binding.

During skiing, the standing and/or carrying plate 5 is subjected to more or less large torques in respect of a transverse ski axis. When the skier is in a forwardly-inclined position, the front end of the standing and/or carrying plate 5 is forced against the top side of the ski. When the skier, in contrast, is in a rearwardly inclined position, the standing and/or carrying plate 5 is subjected to forces and moments which try to raise up the front end of this plate 5 from the ski 1.

Correspondingly oppositely directed forces arise at the rear end of the standing and/or carrying plate 5.

According to an advantageous embodiment of the invention, then, it is possible to provide a torque support 41 by means of which torques which act on the standing and/or carrying plate 5 in respect of the transverse axis are converted into torques in respect of the vertical axis.

Figure 8:
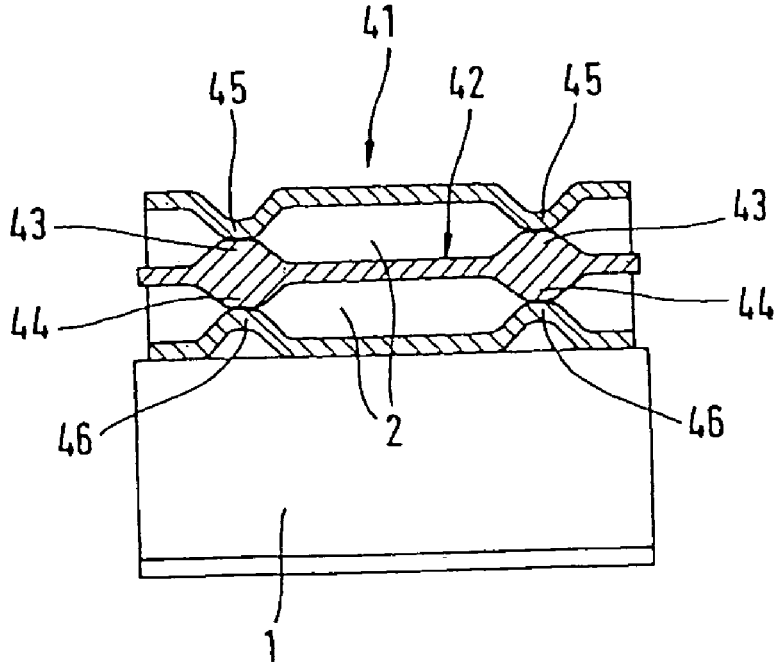
FIG. 8 shows a schematic sectional illustration of a torque support of the standing and/or carrying plate.

As can be gathered from the sectional view of FIG. 8, a profiled strip 42 is firmly arranged on the standing and/or carrying plate 5, this strip extending in the transverse direction of the plate and having, both on its top side and on its underside, in each case two respective elevations 43 and 44, with lateral oblique flanks, and also a horizontal section extending therebetween. Mating elevations 45 and 46 which interact with the elevations 43 and 44 are arranged on the base plate 2.

In FIG. 8, then, the position of the elevations 43 and 44, relative to the mating elevations 45 and 46, are illustrated for the (normal) case where the standing and/or carrying plate 5 assumes its normal, non-pivoted position relative to the base plate 2, i.e. the longitudinal axes of the two plates 2 and 5 coincide with one another in a plan view of the ski 1. In this case, the horizontal sections of the elevations 43 and 44 rest on the corresponding sections of the mating elevations 45 and 46. Irrespective of the magnitude of any possible vertical forces which try to force the front end of the standing and/or carrying plate 5 against the top side of the ski, or try to raise it up from the top side of the ski, and thus result in corresponding pressing forces between the horizontal sections of the mutually opposite elevations 43 to 46, it is not then possible to produce any active torque which tries to rotate the standing and/or carrying plate 5 about its vertical axis. If, however, the standing and/or carrying plate 5 is pivoted some way about the vertical axis counter to the resistance of the first latching device 7, it is possible for the oblique flanks of the mutually opposite elevations 43 to 46 to interact with one another, this resulting in the production of a torque about the abovementioned vertical axis as soon as the front end of the standing and/or carrying plate 5 is forced downward, or raised upward, with the profiled strip 42.

This results in the situation where, when the skier falls in the forward or rearward direction, the standing and/or carrying plate is subjected to an additional torque with respect to the vertical axis as soon as the standing and/or carrying plate 5 has already been deflected out of its central position by a certain extent.

This additional torque counteracts the restoring forces produced by the first latching device 7, with the result that the standing and/or carrying plate 5 can be moved more easily into the rotary position in which a front boot and/or sole holder 8 is unlocked and the boot is disengaged from the binding.

In contrast to the illustration in FIG. 2, it is also possible for the bearing part 4, if appropriate, to be of adjustable design, such that it releases the rear end of the base plate 2 in a release position and the base plate 2, accordingly, can be pivoted up, together with the standing and/or carrying plate 5, about the hinge pin of the bearing part 3. It is thus also possible for the binding according to the invention to be used, if appropriate, as a binding for cross-country skis.

In the case of the embodiment illustrated in the drawing, the front sole holders 8 can be pivoted about axes extending in the longitudinal direction of the standing and/or carrying plate 5. It is also possible, in principle, to provide front sole holders which can be pivoted about vertical and/or oblique axes.

The invention has been described with particular emphasis on the preferred embodiments. It should be appreciated that these embodiments are described for purposes of illustration only, and that numerous alterations and modifications may be practiced by those skilled in the art without departing from the spirit and scope of the invention. It is intended that all such modifications and alterations be included insofar as they come within the scope of the invention or the equivalents thereof.

We claim:

1. A ski boot sole for use with a ski boot binding, the ski boot having a base with a top and a bottom, the binding having a pair of toe holders each rotatable on a longitudinal axis on opposite sides of the longitudinal axis of a ski on which the binding is mounted and a pair of heel holders rotatable about a transverse axis transverse to a ski on which the binding is mounted, said ski boot sole having a forward toe portion and a rear heel portion, said ski boot sole comprising:

a toe exterior insert disposed in the bottom of the ski boot base at the forward toe portion of said boot sole, said toe exterior insert having toe sole holder engaging surfaces for being engaged by a toe holder of a ski binding of a ski to hold the forward toe portion of the ski boot sole in the binding;

a heel exterior insert disposed in the bottom portion of the boot sole in the rearward heel portion of the boot sole, said heel exterior insert having a heel holder engaging surface for being engaged by a heel holder of the ski binding of the ski to hold the rearward heel portion of the ski boot sole in the binding;

a toe interior insert disposed on the top of the base of the ski boot and operably attached to said toe exterior insert to fix said toe exterior insert and said toe interior insert in place on the ski boot sole; and a heel interior insert disposed on the top of the base of the ski boot and operably attached to said heel exterior insert to fix said heel exterior insert and said heel interior insert in place on the ski boot sole;

wherein said toe exterior insert and said heel exterior insert are separated by a fixed dimension regardless of the size of said ski boot sole.

2. A ski boot sole according to claim 1 wherein said toe exterior insert has threaded bores for receiving a screw, said toe interior insert is a toe threaded interior insert with threaded tubes for receiving the same screw as said threaded bores of said toe exterior insert, said toe exterior insert and said toe threaded interior insert being attached to the base of the boot with said threaded bores and said threaded tubes being aligned for receiving a screw to attach said toe exterior insert and said toe threaded interior insert; and wherein said heel exterior insert has threaded bores for receiving a screw, said heel interior insert is a heel threaded interior insert with threaded tubes for receiving the same screw as said threaded bores of said heel exterior insert, said heel exterior insert and said threaded heel interior insert being attached to the base of the boot with said threaded bores and said threaded tubes being aligned for receiving a screw to attach said heel exterior insert and said heel threaded interior insert.

3. A ski boot sole according to claim 1 wherein the fixed dimension is generally 148 mm with a manufacturing tolerance of ±10 mm.

4. A ski boot sole for use with a ski boot binding, the ski boot having a base with an upwardly-extending forward depression and an upwardly-extending rearward depression in the forward and rearward portion of the base, the binding having a pair of toe holders each rotatable on a longitudinal axis on opposite sides of the longitudinal axis of a ski on which the binding is mounted and a pair of heel holders rotatable about a transverse axis transverse to a ski on which the binding is mounted, said ski boot sole comprising:

a forward toe sole extending from the front of said ski boot sole rearwardly and terminating at the forward edge of a forward gap aligned with the forward depression in the forward portion of the bottom;

a central toe sole extending rearwardly from the rear edge of the forward gap and terminating at a position partway along the length of said sole;

a heel sole extending rearwardly from a back part of said sole at least to the rear end of said ski boot sole;

a toe exterior insert provided in the forward gap between said toe sole and said central sole, said toe exterior insert extending into the forward depression of the boot base, said toe exterior insert cooperating with the pair of toe holders to releasably hold the boot toe in the binding;

a toe interior insert provided in the upper part of the boot base in alignment with said toe exterior insert for attachment with said toe exterior insert, and a toe insert attaching device for attaching said toe exterior insert and said toe interior insert;

a heel exterior insert disposed forwardly of said heel sole and extending into the rearward depression of the boot base, said boot exterior insert cooperating with the heel holders to releasably hold the heel of the boot in the binding; and a heel interior insert provided in the boot base in alignment with said heel exterior insert, and heel insert attaching device for attaching said heel exterior insert and said heel interior insert;

wherein said toe exterior insert and said heel exterior insert are spaced apart by a fixed dimension regardless of the size of said boot sole.

5. A ski boot sole according to claim 4 wherein the spacing apart of said toe exterior insert and said heel exterior insert is measured between the rearwarddmost part of said toe exterior insert and the forwardmost part of said heel exterior insert, and said fixed distance is 148 mm with a manufacturing tolerance of ±10 mm.

6. A ski boot sole according to claim 4 wherein said toe interior insert has a fixed longitudinal dimension regardless of the size of said ski boot sole.

7. A ski boot sole according to claim 4 wherein the ski boot has a downwardly-extending part extending from the base of the boot, said toe exterior insert being attachable to the downwardly-extending part, said toe exterior insert having outwardly-extending side portions for engagement by the toe holders to releasably hold the forward portion of said ski boot sole in the binding.

8. A ski boot sole according to claim 4 wherein the ski boot base has a rear recess and the heel holder is able to rotate in the recess, said heel exterior insert being mountable on the ski boot base with said heel exterior insert extending partly across the recess for being engaged by the heel holders to releasably hold the rearward part of said ski boot sole in the binding.

9. A ski boot sole for use with a ski boot binding, the ski boot having a base with an upwardly-extending forward depression and an upwardly-extending rearward depression in the respective forward and rearward portions of the base of the boot, the binding having at least one toe holder rotatable about a longitudinal axis extending along a side of the binding and at least one heel holder rotatable about a transverse axis transverse to the binding; said ski boot binding comprising:

a forward toe sole extending rearwardly from the front of said ski boot sole and terminating at the forward edge of a forward gap located at the forward end of the forward depression at the base of the ski boot, the forward gap extending rearwardly;

a central toe sole extending rearwardly from a position between the forward gap and the rearward depression, terminating at a position between the forward gap and a forward edge of a rearward gap, the rearward gap being located at the forward edge of the rearward depression at the base of the ski boot, the rearward gap extending rearwardly;

a heel sole extending rearwardly from the rearward end of the rearward depression at least to the rear end of said ski boot sole;

a toe exterior insert located in the forward gap and in the forward depression in the base of the ski boot for being attached to the base of the ski boot, said toe exterior insert being engageable by the at least one toe holder to releasably lock the forward portion of the base of the ski boot in the binding; and a heel exterior insert located in the rearward gap and extending into the rearward depression in the base of the ski boot for being attached to the base of the ski boot, said heel exterior insert being engageable by the at least one heel holder to releasably lock the rearward portion of the base of the ski boot in the binding.

10. A ski boot sole according to claim 9 wherein said toe exterior insert and said heel exterior insert are spaced apart by a fixed dimension regardless of the size of said ski boot sole.

11. A ski boot sole according to claim 10 wherein said fixed dimension is 148 mm with a manufacturing tolerance of ±10 mm.

12. A ski boot sole according to claim 9 wherein said toe exterior insert has a forwardmost end and said heel exterior insert has a rearwardmost end, and the distance between said forwardmost end and said rearwardmost end is a fixed dimension regardless of the size of said ski boot sole.

13. A ski boot sole according to claim 12 wherein said fixed dimension is 200 mm with a manufacturing tolerance of ±10 mm.

14. A ski boot sole according to claim 9 and further including a rearwardly-extending ridge portion having said heel exterior ridge attached thereto, said heel exterior insert having a rearwardly extending rear portion overhanging said ridge portion for releasable engagement by the heel holder.

15. A ski boot base according to claim 14 and further including an interior heel insert structure for receiving a heel interior insert aligned with the heel exterior insert, wherein the heel interior insert and the heel exterior insert have aligned fastener holes for receiving rearward attaching fasteners, and further including bores aligned with the aligned fastener holes for enabling the rearward attaching fasteners to attach the heel interior insert and the heel exterior insert together.

16. A ski boot base for use with a ski boot sole for cooperating with a ski boot binding, the ski boot binding having a pair of toe holders rotatable about longitudinal axes on opposite sides of the binding and a pair of heel holders rotatable about a transverse axis, and the ski boot sole having a forward toe sole extending rearwardly from the front of said ski boot base and terminating at the forward edge of a forward gap located in the forward end portion of said ski boot base, a toe exterior insert for cooperating with the toe holders to releasably lock the toe sole portion in the ski binding, a central toe sole portion extending rearwardly from a position between the forward gap to a rearward position located forwardly of a rearward gap, the rearward gap being located in a rearward portion of said ski boot base, and a heel sole portion extending from the rearward edge of the rearward gap and terminating at least at the rearward end of said ski boot base, and a heel exterior insert for cooperating with the heel holders to releasably lock the heel sole portion in the ski binding, said ski boot base having a top and a bottom, and comprising:

a forward depression located in the bottom of said ski boot base at the forward gap, said forward depression receiving the toe exterior insert;

a downwardly-extending part running longitudinally in said forward depression and inwardly of outer sides of the toe exterior insert to create a space between the bottom of said ski boot base and the outer sides of the toe exterior insert for enabling the toe holders to releasably engage the outer sides of the toe exterior insert;

a pair of forward recesses in the bottom of said ski boot base located forwardly of said forward depression for enabling the rotation of the toe holders about the longitudinal axes to releasably engage the toe exterior insert;

a rearward depression located in the bottom of said ski boot base at the rearward gap, said rearward depression receiving the heel exterior insert; and a pair of rearward recesses located in the bottom of said ski boot base extending beneath a rearwardly-extending rear portion of the heel exterior insert for enabling the rotation of the heel holders for releasably engaging the heel exterior insert to releasably lock the heel exterior insert.

17. A ski boot base according to claim 16 and further including an interior toe insert structure for receiving a toe interior insert aligned with the toe exterior insert, wherein the interior toe insert and the exterior toe insert have aligned fastener holes for receiving forward attaching fasteners, and said ski boot base further including bores aligned with the aligned fastener holes for enabling the forward attaching fasteners to attach the toe interior insert and the toe exterior insert together.

18. The combination of a ski boot base and a ski boot sole for use with a ski boot binding, the ski boot binding having a pair of toe holders rotatable about longitudinal axes on opposite sides of the binding and a pair of heel holders rotatable about a transverse axis, said combination comprising:

a ski boot base having a front, a rear, a top and a bottom, and comprising:

a forward depression located in the bottom of said ski boot base;

a downwardly-extending part running longitudinally in said forward depression;

a pair of forward recesses in the bottom of said ski boot base located forwardly of said forward depression for enabling the rotation of the toe holders about the longitudinal axes;

a rearward depression located in the bottom of said ski boot base; and a pair of rearward recesses located on the bottom of said ski boot base located rearwardly of said rearward depression for enabling the rotation of the heel holders; and a ski boot sole comprising:

a forward toe sole attached to said ski boot base, extending rearwardly from the front of said ski boot base and terminating at a forward end of said forward depression;

a toe exterior insert located in said forward depression and also located on said downwardly-extending part, said toe exterior insert having outwardly-extending side portions for releasable engagement by the toe holders;

a central toe sole attached to said ski boot base, extending rearwardly from the rearward end of said forward depression and establishing a forward gap between the rearward end of said forward toe sole and the forward end of said central toe sole;

a heel exterior insert located in said rearward depression, said heel exterior insert having a rearwardly extending rear portion overhanging said rearward recesses for releasable engagement by the heel holders; and a heel sole attached to said ski boot base, extending rearwardly from the rearward end of said rearward depression at least to the rear end of said ski boot base.

19. The combination of a ski boot base and a ski boot sole according to claim 18 wherein the distance between the rearward end of said toe exterior insert and the forward end of said heel exterior insert is spaced apart by a fixed dimension regardless of the size of said ski boot base and said ski boot sole.

20. The combination of a ski boot base and a ski boot sole according to claim 19 wherein said fixed dimension is 148 mm with a manufacturing tolerance of ±10 mm.

21. The combination of a ski boot base and a ski boot sole according to claim 18 wherein the dimension between the forward end of said toe exterior insert and the rearward end of said heel exterior insert is 200 mm with a manufacturing tolerance of ±10 mm.

22. The combination of a ski boot base and a ski boot sole according to claim 18 and further comprising:

a toe interior insert located in the top of said ski boot base in alignment with said toe exterior insert for attachment with said toe exterior insert; and a toe insert attaching device for attaching said toe exterior insert and said toe interior insert.

23. The combination of a ski boot base and a ski boot sole according to claim 18 and further including:

a heel interior insert located in the top of said ski boot base in alignment with said heel exterior insert for attachment with said heel exterior insert; and a heel insert attaching device for attaching said heel exterior insert and said heel interior insert.

24. A combination of a ski boot base, a ski boot sole and a ski binding, said combination comprising:

a ski boot base having a front, a rear, a top and a bottom, said ski boot base comprising:

a forward depression located in the bottom of said ski boot base;

a downwardly-extending part running longitudinally in said forward depression;

at least one forward, toe holder-receiving recess in the bottom of said ski base;

a rearward depression located in the bottom of said ski boot base; and at least one rearward, heel holder-receiving recess in the bottom of said ski boot base;

a ski boot sole comprising:

a forward toe sole attached to said ski boot base, extending rearwardly from the front of said ski boot base and terminating at a forward end of said forward depression;

a toe exterior insert located in said forward depression and also located on said downwardly-extending part, said toe exterior insert having at least one outwardly-extending side portion;

a central toe sole attached to said boot base, extending rearwardly from the rear end of said forward depression and establishing a forward gap between the rearward end of said forward toe sole and the forward end of said central sole;

a heel exterior insert located in said rearward depression; and a heel sole attached to said ski boot base, extending rearwardly from the rearward end of said rearward depression at least to the rear end of said ski boot base; and a ski binding comprising:

at least one toe holder rotatable about longitudinal axes and having a toe exterior insert holder rotatable into said at least one forward toe holder recess in said ski boot base for releasably engaging said at least one outwardly-extending side portion of said toe exterior insert to releasably lock the forward portions of said ski boot base and said ski boot sole in said ski boot binding; and at least one heel holder rotatable about a transverse axis and having a heel exterior insert holder rotatable into said at least one rearward, heel holder-receiving recess in the bottom of said ski boot base for releasably engaging said heel exterior insert to releasably lock the rear portions of said ski boot base and said ski boot sole in said ski boot binding.

25. The combination of said ski boot base, said ski boot sole and said ski binding according to claim 24, wherein the distance between the rearward end of said toe exterior insert and the forward end of said heel exterior insert is spaced apart by a fixed dimension regardless of the size of said ski boot base and said ski boot sole.

26. The combination of a ski boot base, a ski boot sole and a ski binding according to claim 25, wherein said fixed dimension is 148 mm with a manufacturing tolerance of ±10 mm.

27. The combination of the ski boot base, a ski boot sole and a ski binding according to claim 25, wherein the distance between the forward end of said toe exterior insert and the rearward end of said heel exterior insert is 200 mm with a manufacturing tolerance of ±10 mm.

28. The combination of a ski boot base, a ski boot sole and a ski binding according to claim 25 and further including:

a toe interior insert located in the top of said ski boot base in alignment with said toe exterior insert for attachment to said toe exterior insert; and a toe insert attaching device for attaching said toe exterior insert and said heel interior insert.

29. The combination of a ski boot base, a ski boot sole and a ski binding according to claim 25 and further including:

a heel interior insert located in the top of said ski boot base in alignment with said heel exterior insert for attachment to said heel exterior insert; and a heel insert attaching device for attaching said heel exterior insert and said heel interior insert.

* * * * *